US010065897B2

(12) United States Patent
Hultman et al.

(10) Patent No.: US 10,065,897 B2
(45) Date of Patent: Sep. 4, 2018

(54) PYROTECHNICS CONTAINING OLEORESIN

(71) Applicant: Safariland, LLC, Jacksonville, FL (US)

(72) Inventors: John Hultman, Casper, WY (US); Patrick McKee, Springville, UT (US)

(73) Assignee: Safariland, LLC, Jacksonville, FL (US)

( * ) Notice: Subject to any disclaimer, the term of this patent is extended or adjusted under 35 U.S.C. 154(b) by 178 days.

(21) Appl. No.: 14/711,980

(22) Filed: May 14, 2015

(65) Prior Publication Data

US 2015/0329437 A1 Nov. 19, 2015

Related U.S. Application Data

(60) Provisional application No. 61/993,780, filed on May 15, 2014.

(51) Int. Cl.

| | |
|---|---|
| ***C06B 29/20*** | (2006.01) |
| ***F41H 9/00*** | (2006.01) |
| ***C06B 23/00*** | (2006.01) |
| ***C06B 33/08*** | (2006.01) |
| ***C06B 33/14*** | (2006.01) |
| ***C06D 7/00*** | (2006.01) |
| *D03D 23/00* | (2006.01) |
| *D03D 43/00* | (2006.01) |

(52) U.S. Cl.

CPC ..... *C06B 29/20* (2013.01); *C06B 23/007* (2013.01); *C06B 33/08* (2013.01); *C06B 33/14* (2013.01); *C06D 7/00* (2013.01); *F41H 9/00* (2013.01)

(58) Field of Classification Search

USPC ..... 149/79

See application file for complete search history.

(56) References Cited

U.S. PATENT DOCUMENTS

| | | | | |
|---|---|---|---|---|
| RE16,495 | E | 12/1926 | Bradner | |
| RE16,841 | E | 1/1928 | Bradner | |
| 3,335,040 | A | 8/1967 | Niles | |
| 3,706,611 | A * | 12/1972 | Hastings | C06B 33/02 149/116 |
| 4,997,497 | A | 3/1991 | Wilson et al. | |
| 5,217,708 | A | 6/1993 | Pinkney | |
| 5,655,461 | A | 8/1997 | Gilbert | |
| 5,750,918 | A | 5/1998 | Mangolds et al. | |
| 5,821,450 | A | 10/1998 | Fedida | |
| 6,374,741 | B1 | 4/2002 | Stanley et al. | |
| 6,399,073 | B2 | 6/2002 | Pinkney | |

(Continued)

OTHER PUBLICATIONS

Anthony, JS et al, "Chemical Characterization of the Pyrotechnically Disseminated M83-PE Smoke Grenades" Edgewood Arsenal, Jun. 2003; abstract; p. 20, table 1.

(Continued)

*Primary Examiner* — James E McDonough

(74) *Attorney, Agent, or Firm* — Kane Kessler, P.C.; Paul E. Szabo

(57) ABSTRACT

A pyrotechnic composition includes a fuel, an oxidizer, flow and rate control agents and oleoresin capsicum as an irritant. The composition is useful in crowd control products. The composition contains rate control ingredients to maintain combustion at a temperature below the point of degradation of the oleoresin capsicum, balanced with a booster material to maintain combustion.

6 Claims, 2 Drawing Sheets

(56) References Cited

U.S. PATENT DOCUMENTS

| | | | | |
|---|---|---|---|---|
| 6,412,416 | B1 * | 7/2002 | Rouse | F42B 5/15 102/334 |
| 6,523,478 | B1 | 2/2003 | Gonzalez et al. | |
| 6,688,032 | B1 | 2/2004 | Gonzalez et al. | |
| 7,191,579 | B2 | 3/2007 | Bartholf et al. | |
| 8,128,766 | B2 | 3/2012 | Pile et al. | |
| 8,276,519 | B2 | 10/2012 | Menefee, III et al. | |
| 8,365,668 | B2 | 2/2013 | Brunn | |
| 8,689,695 | B2 | 4/2014 | Burdine et al. | |
| 8,720,341 | B2 | 5/2014 | Brunn | |
| 8,807,004 | B1 | 8/2014 | Menefee, III | |
| 2013/0125773 | A1 | 5/2013 | Brunn | |

OTHER PUBLICATIONS

Wesolowska, A et al, "Chemical Composition of the Pepper Fruit Extracts of Hot Cultivars" Capsicum annuum L. Acta Acta Sci.Pol., Hortorum Cultus. vol. 10, No. 1, 2011; pp. 173, 175.

PCT Appln. No. PCT/US15/30780, International Search Report and Written Opinion dated Aug. 21, 2015.

European Patent App. No. 15792021.6—Search report dated May 2, 2017.

* cited by examiner

PYROTECHNICS CONTAINING OLEORESIN

BACKGROUND OF THE INVENTION

The present invention relates to crowd control products. More specifically, the invention relates to a pyrotechnic material that carries an irritant, as is commonly used in less-lethal applications; and to a munition that carries such a pyrotechnic material. Such a munition can be propelled by hand, such as a hand grenade. Alternatively, such a munition can be ejected from a launching device such as a firearm; one well known form of such a munition is the 40 mm projectile, which is a relatively large, slow speed, and short distance projectile.

Such a munition typically includes as its active ingredient an irritant. The irritant is dispersed by products of a pyrotechnic reaction, including smoke. The smoke is generated by burning a mixture of fuel and oxidizer. This mixture may be ignited upon launching of the product, or it may be ignited during flight after a predetermined delay period, or upon impact. After the mixture is ignited, the smoke that is produced disperses, and carries with it the irritant.

Historically, CN and CS "tear gas" have been used as the irritant in such munitions. Tear gas is a lachrymatory agent (a chemical compound that irritates eyes to cause tears, pain, and, in some cases, temporary blindness). Pyrotechnics containing tear gas have been effectively manufactured as dry, pelletized material and assembled in munitions.

Another known lachrymatory agent is pepper spray, or Oleoresin

Capsicum ("OC"). Aerosols of pepper spray were developed and gained popularity as a more friendly, both physiologically and environmentally, alternative to "tear gas". While predominantly used in aerosol form, OC has also been manufactured as a blast powder agent.

Characteristics common to all such irritants include a rapid onset (measured in seconds as opposed to minutes); a brief duration of acute effects (10-30 minutes); a relatively low dose required to cause tissue irritation or pain; and a significantly larger dose required to (undesirably) cause death.

One concern with munitions containing an irritant is the tear-producing effect. Specifically, too much tearing can lead to unclear vision, and a lack of clear vision prevents subjects from safely exiting an affected area (crowd dispersion).

Raw OC is classified as an inflammatory, causing acute burning and closing of the eyes, along with severe inflammation of the mucous membranes and upper respiratory system. However, in some formulations it shows a reduced tearing effect and is thus more desirable than "tear gas" chemicals; it affects only the respiratory systems of targeted subjects, leaving their eyes largely undisturbed. This could help exposed subjects to retain sufficient optical clarity for safe egress.

In the past OC has not been successfully used in a product of this type, for several reasons. First, OC is a plant-based extract in liquid phase, and thus is difficult to include as part of a dry fuel and oxidizer mixture amenable to consolidation and ignition (the needed configuration for such a munition). Second, the component of the OC that is responsible for its irritant properties can degrade when exposed to the high temperatures that occur with some pyrotechnic reactions; in contrast, slowing down the reaction by lowering the temperature of combustion can undesirably decrease reaction time and/or result in incomplete burning.

DESCRIPTION OF THE INVENTION

In general, this invention relates to a smoke composition comprising oleoresin capsicum (OC) that is part of a pyrotechnic composition containing oxidizer(s) and reducer(s) that are tailored to allow a combustion reaction without complete degradation of OC compounds. With increases in OC solids content a mixing procedure has been developed which adds flowing agents to liquid solution, separately mixed, before combining with other pyrotechnic components. Together with additional booster (combustion enhancer) and flow agent components, this process produces pyrotechnic material meeting the aforementioned performance requirements. It also generates material that can be reproduced and used without issue in fabricating associated munitions.

This invention incorporates OC into a pyrotechnic composition. Dry components of fuel, oxidizer, and flow agents are mixed together with each other. Separately, a binder component, including the OC, is mixed as a solution. Dry, stabilizing, flow agents are also blended in the wet binder solution. The wet and dry mixtures are then blended together to form the pyrotechnic composition.

A booster material (combustion enhancer) in the form of a powder is blended into the pyrotechnic composition. This booster material promotes manufacturability by absorbing additional moisture and reducing friction of composition inside press equipment. In addition, this booster material leads to more consistent performance by reducing the amount of energy required for transfer of ignition from the initiating device to the consolidated pyrotechnic composition. The addition of flow agents to the OC binder solution, and the addition of the booster material, produce successful consolidation and performance of the overall composition, which can be easily mixed, pressed, and ignited with desired effects.

Figure 1:
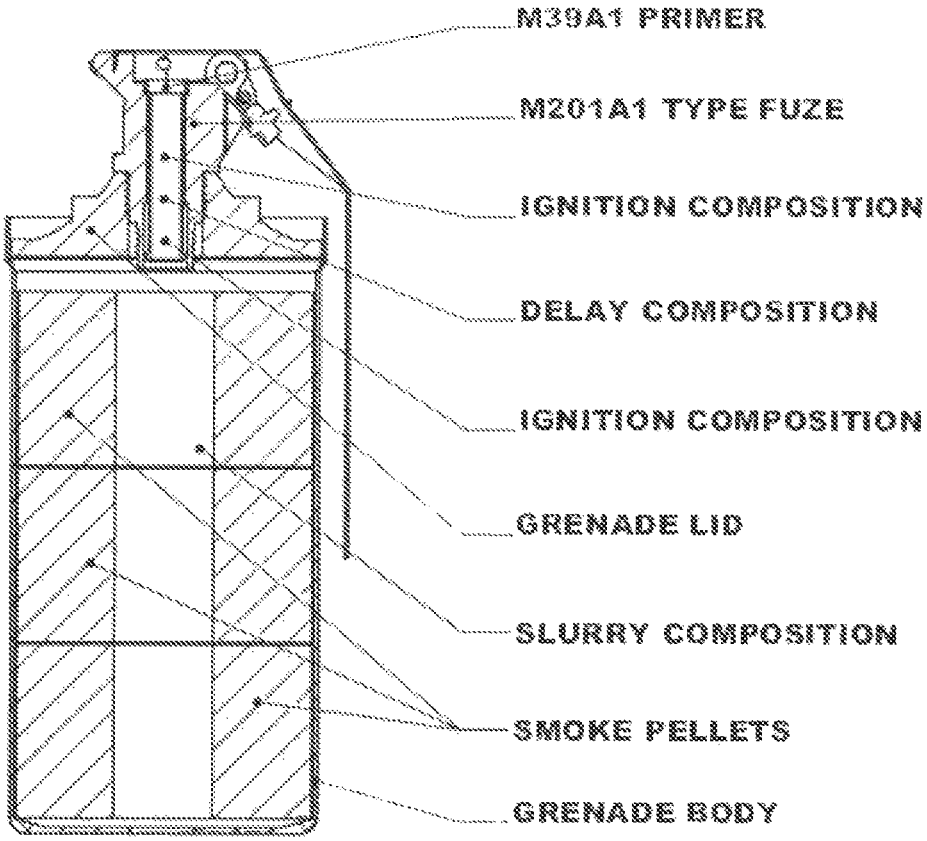
FIG. 1 is a simplified diagram of a munition of the type that can contain a pyrotechnic material in accordance with the invention, specifically, a hand grenade.

A composition of the present invention can be carried by a container such as a grenade of the type illustrated generally in FIG. 1. The composition may be prepared as follows.

The method includes generally the following steps: Prepare a first mixture (which may be a dry mix) including fuel and oxidizer; make a second mixture (which may be a wet solution) including OC; blend the first mixture with the second mixture to form the smoke composition; dry and granulate the smoke composition; and prepare and add a booster material.

Figure 2:
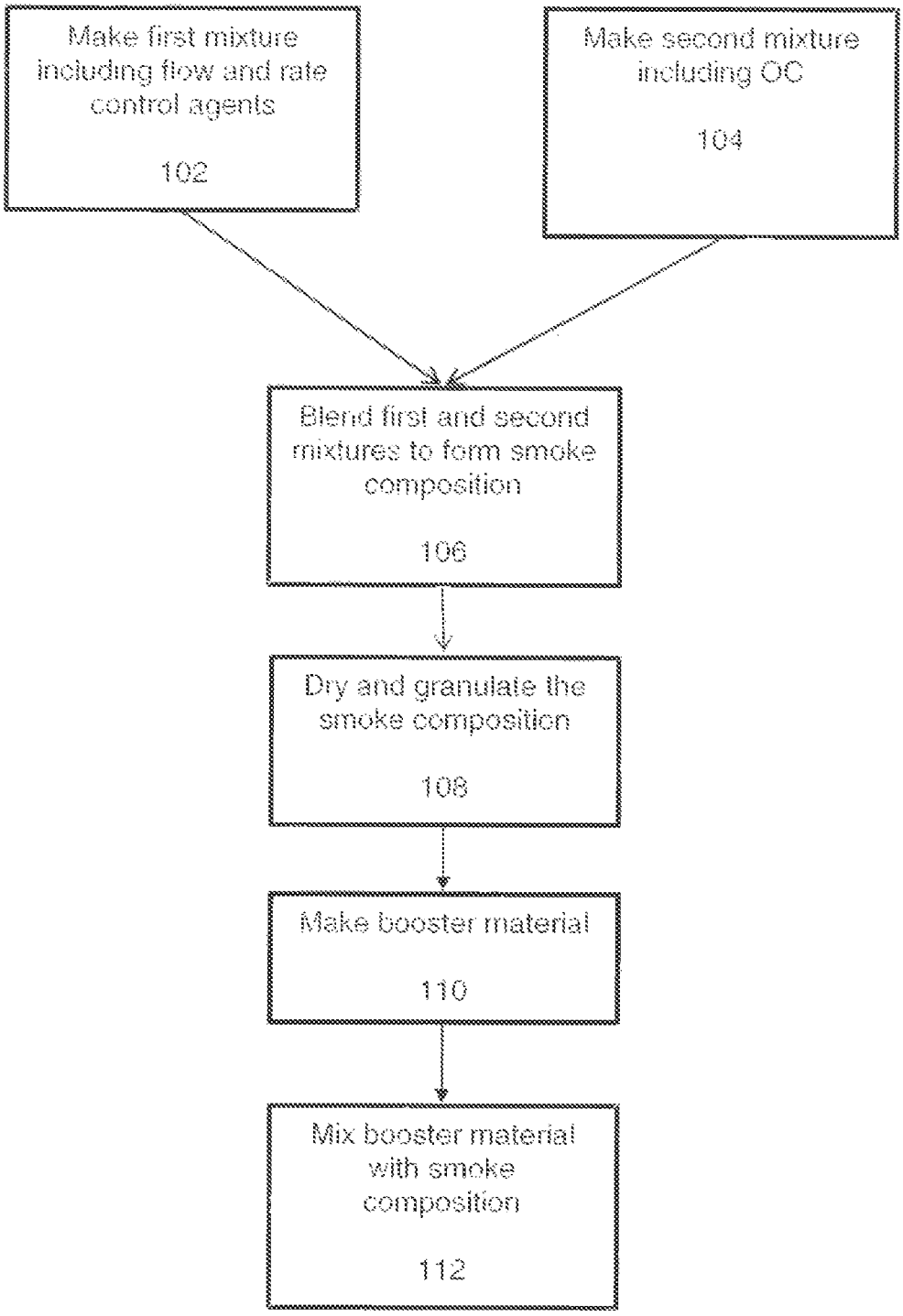
FIG. 2 is a simplified flow chart showing a manufacturing process in accordance with the invention.

In an initial step, a first mixture is prepared (FIG. 2, step 102) that includes 14% to 24% and preferably 17% to 21%, potassium chlorate; 3% to 22%, and preferably 11 to 16% baker's sugar; 6% to 22% and preferably 8% to 13%, magnesium carbonate (a rate controlling agent); 20% to 40% and preferably 25% to 30%, terephthalic acid; 2% to 28% and preferably 2% to 6% dye; 1% to 25%, and preferably 2% to 6% magnesium stearate (flow and rate controlling and drying agent); and 20% to 35%, and preferably 26% to 30% nitrocellulose. These components are mixed then dried at room temperature.

In a separate step, a second mixture is prepared (step 104) that includes the OC, which is the irritant ingredient. The second mixture is a blend of 3% to 26%, and preferably 6% to 10% OC; and 74% to 97%, and preferably 90% to 94% acetone. The second mixture preferably also includes a flow agent in the form of 1% to 10%, and preferably 1% magnesium stearate. Use of a flow agent of the proper proportions and physical properties can improve homogeneity and reduce clumping of this blend. Excessive amounts of a flow agent, for example more than 8% to 20% by total weight and possibly less than 8% to 20%, can inhibit consolidation and ignition of the final composition.

The second mixture is then added to the first mixture (step 106) to make the basic pyrotechnic smoke composition, which is then dried and granulated (step 108).

Separately, a booster material (combustion enhancer) is prepared for addition to the basic pyrotechnic smoke composition, to increase batch weight by up to 3% to 15%, and preferably 7% to 10%. Specifically, a booster material is provided (step 110) that is a combination of (a) magnesium stearate and (b) a dry slurry powder that is made of approximately 10% to 20% and preferably 15% to 18% silicon; 20% to 35% and preferably 25% to 28% potassium nitrate; 1% to 15% and preferably 2% to 5% carbon; 15% to 30% and preferably 25% to 28% iron oxide; 5% to 20% and preferably 10% to 15% aluminum; and 15% to 25% and preferably 16% to 20% nitrocellulose. This booster material is added (step 112) to the pyrotechnic composition in the form of a powder.

A typical pyrotechnic material without rate controlling agents can generate temperatures in excess of 1000° F., in standard atmospheric conditions. Such temperatures can, as noted above, degrade OC. With the present invention, however, degradation of the OC is limited through control of temperature via the rate controlling agents. This effect is balanced by use of the booster material, which increases sensitivity of the pyrotechnic material, i.e., its ability to burn. This balance maintains combustion of the bulk pyrotechnic material at a controlled rate while avoiding excessive thermal output of the reaction which would lead to OC decomposition.

Smoke, a solid particulate, is generated from burning of the consolidated pyrotechnic composition. The smoke is coupled to the OC solids, carrying them into the air. Exposure to the pyrotechnic OC composition of the present invention produces rapid inflammation of respiratory tracts and difficulty breathing without pain. In highly concentrated doses, the applied OC can induce severe coughing and vomiting. Almost all immediate effects (such as nasal discharge and coughing) cease shortly after cessation of exposure, within 10 minutes as compared to 30 to 60 minutes for tear gas, although in a few cases a feeling of burning and irritated skin may persist for hours. Room clean up is also much easier and quicker when compared to traditional OC and tear-gas products, as tear gas permeates surfaces while OC does not; the OC can simply be rinsed away.

From the above description, those skilled in the art will perceive improvements, changes, and modifications in the invention. Such improvements, changes, and modifications within the skill of the art are intended to be covered by the appended claims.

We claim:

1. A pyrotechnic composition comprising:
a fuel;
an oxidizer;
flow and rate control agents;
oleoresin capsicum; and
further including a booster material that includes:
(a) magnesium stearate; and
(b) a dry slurry powder that is made of approximately 10% to 20% silicon; 20% to 35% potassium nitrate; 1% to 15% carbon; 15% to 30% iron oxide; 5% to 20% aluminum; and 15% to 25% nitrocellulose.

2. A pyrotechnic composition as set forth in claim 1 wherein the dry slurry powder is made of approximately 15% to 18% silicon, 25% to 28% potassium, 2% to 5% carbon, 25% to 28% iron oxide, 10% to 15% aluminum, and 16% to 20% nitrocellulose.

3. A pyrotechnic composition as set forth in claim 1 wherein a mixture including the fuel and oxidizer includes approximately 13% to 24% potassium chlorate, 3% to 22% baker's sugar, 6% to 22% magnesium carbonate, 20% to 40% terephthalic acid, 2% to 28% dye, 1% to 25% magnesium stearate, and 20% to 35% nitrocellulose.

4. A pyrotechnic composition comprising:
a fuel;
an oxidizer;
flow and rate control agents;
oleoresin capsicum;
a booster material that is combined with magnesium stearate;
and further including a dry slurry powder that is made of approximately 10% to 20% silicon; 20% to 35% potassium nitrate; 1% to 15% carbon; 1% to 30% iron oxide; 5% to 20% aluminum; and 15% to 25% nitrocellulose.

5. A pyrotechnic composition as set forth in claim 4 wherein the dry slurry powder is made of approximately 15% to 18% silicon, 25% to 28% potassium, 2% to 5% carbon, 25% to 28% iron oxide, 10% to 15% aluminum, and 16% to 20% nitrocellulose.

6. A pyrotechnic composition as set forth in claim 4 wherein a mixture including the fuel and oxidizer includes approximately 13% to 24% potassium chlorate, 3% to 22% baker's sugar, 6% to 22% magnesium carbonate, 20% to 40% terephthalic acid, 2% to 28% dye, 1% to 25% magnesium stearate, and 20% to 35% nitrocellulose.

* * * * *